US006438901B1

(12) United States Patent
Tan et al.

(10) Patent No.: US 6,438,901 B1
(45) Date of Patent: Aug. 27, 2002

(54) SHIELDING APPARATUS FOR PROTECTING A MACHINE

(75) Inventors: Kok-Weng Tan, Hsin-Chu Hsien; Hung-I Shu; Yu-Chun Chiu, both of Hsin-Chu; Heng-Chang Hsieh, Chia-I Hsien, all of (TW)

(73) Assignee: United Microelectronics Corp., Hsin-Chu (TW)

( * ) Notice: Subject to any disclaimer, the term of this patent is extended or adjusted under 35 U.S.C. 154(b) by 51 days.

(21) Appl. No.: 09/754,324

(22) Filed: Jan. 5, 2001

(51) Int. Cl.[7] ..... E04D 13/00

(52) U.S. Cl. ..... 52/11; 52/302.1; 52/302.3; 52/506.06

(58) Field of Search ..... 52/506.06, 11, 52/302.1, 302.3, 97

(56) References Cited

U.S. PATENT DOCUMENTS 3,685,235 A * 8/1972 Lang
3,791,089 A * 2/1974 Alderman
3,848,385 A * 11/1974 Thonpson
4,261,143 A * 4/1981 Rizzo
4,878,330 A * 11/1989 Machin
4,947,607 A * 8/1990 Stein
5,258,079 A * 11/1993 Nakatsukasa
5,729,931 A * 3/1998 Wade
6,050,030 A * 4/2000 Wax
6,279,271 B1 * 8/2001 Burkart
6,308,479 B1 * 10/2001 Prohofsky

* cited by examiner

*Primary Examiner*—Carl D. Friedman
*Assistant Examiner*—Kevin McDermott
(74) *Attorney, Agent, or Firm*—Winston Hsu

(57) ABSTRACT

The present invention provides a shielding apparatus installed over a machine in a clean room to protect the machine. The shielding apparatus comprises at least two supporting beams, and a plurality of rectangular-shaped plate flaps in parallel to each other. The flaps are connected to the supporting beams at an angle, and each flap has areas overlapping with its neighboring flap along a vertical cross-section. Each flap is an anti-acid zinc-plated steel plate with a drain piping connected its bottom to collect and deliver processing liquids.

20 Claims, 6 Drawing Sheets

SHIELDING APPARATUS FOR PROTECTING A MACHINE

BACKGROUND OF THE INVENTION

1. Field of the Invention

The present invention relates to a shielding apparatus for protecting a machine, and more particularly, to a shielding apparatus fixed above the machine to protect the machine.

2. Description of the Prior Art

In general Fab, all processes are performed in a clean room. To save space, a plurality of mezzanines are adopted in the clean room whereby both a mesh anti-acid zinc-plated steel ledge and a handrail are installed at a predetermined height followed by the installation of a chief machine and a plurality of lines and tubing.

However, two design problems occur. The first problem is the inability of the mesh anti-acid zinc-plated steel ledge and the handrail to protect the machine and the people below from falling tools and debris due to the existence of an interspace between the mesh and the handrail. The second problem is the escape of acidic and basic process liquids or volatile gases used during processes in the tubing and the lines, such as the mixture of nitric acid and hydrofluoric acid to remove silicon dioxide in the wet etching process. These process liquids or volatile gases may escape from the joint of the lines and the tubing or from the machines on the mesh, and through the interspace of the mesh and the handrail to harm the machines and people below.

The high volatility and corrosiveness of the process liquids or gases can lead to severe physical damage to those they contact. As well, the process liquids or volatile gases can lead to the corrosion of the machines and electric circuits below, resulting in breakdown of the entire machine and hindering the subsequent processes of a production line. As well, within the clean room, particles volatilized from the process liquids or gases can damage the wafer surface.

Please refer to FIG. 1. FIG. 1 is a schematic diagram of the prior art. In the prior art, a shielding apparatus 100 is installed within a clean room 200. The clean room 200 comprises the shielding apparatus 100, an air filter 202, a gas inlet 204, a gas outlet 206, a mesh steel ledge 208, a machine 210*a* positioned atop the mesh steel ledge 208, and a machine 210*b* positioned below the mesh steel ledge 208. The shielding apparatus 100 comprises an anti-acid zinc plate 102 fixed above the machine 210*b*, and four supporting beams 104 positioned vertically at the four corners of the anti-acid zinc plate 102 (only two of 104 are shown). The anti-acid zinc plate 102 has a greater area than that of the machine 210*b* to allow for the protection of the people and the machine below.

The clean room 200 uses the air filter 202, the gas inlet 204, and the gas outlet 206 to maintain a proper level of cleanliness. For example, the air filter 202 removes the particles in the air, the gas inlet 204 supplies fresh air into the clean room 200 and attenuates the concentration of the particles in the air, while the gas outlet 206 expels the air out of the clean room 200 to allow for sufficient convection.

The original design of the clean room 200 is to maintain cleanliness through sufficient filtration of particles by the air filter 202 as well as maintaining sufficient convection by the gas inlet 204 and the gas outlet 206 (as shown by arrow heads). However, the location of the shielding apparatus 100 of the prior art hinders air circulation (as shown by arrow heads) and consequently, hinders the ability of the clean room to maintain a proper level of cleanliness.

Although the structure of the prior art protects the people and the machine from the formed process liquids or volatile gases as well as from falling tools and debris, it hinders air circulation and therefore affects the maintenance of a proper cleanliness level.

SUMMARY OF THE INVENTION

It is an object of the present invention to provide a shielding apparatus to solve the above mentioned-problems.

In accordance with the claimed invention, the present invention provides a shielding apparatus installed over a machine in a clean room to protect the machine. The shielding apparatus comprises at least two supporting beams and a plurality of rectangular-shaped plate flaps placed parallel to each other. The flaps are connected to the supporting beams at an angle, and each flap has areas overlapping with the neighboring flap along a vertical cross-section. The smallest length of edge area projected on the vertical cross-section is between 1 mm to 20 cm. Each flap is an anti-acid zinc-plated steel plate, and is connected to the bottom of the neighboring flap by a mesh plate. A drain piping is connected to the bottom of each flap to collect and deliver process liquids.

It is an advantage of the present invention that the shielding apparatus can efficiently solve the above-mentioned problems.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
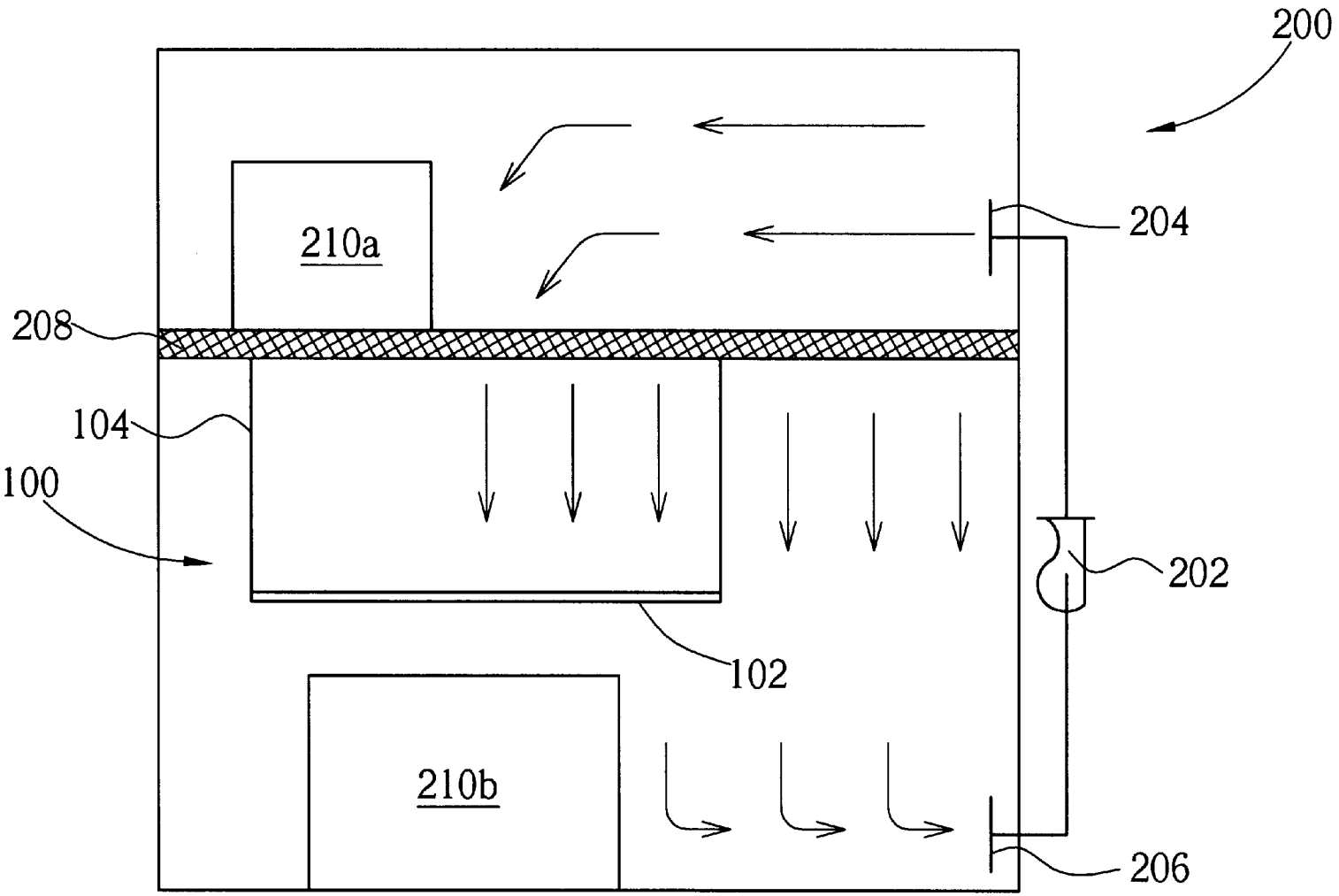
Fig. 1 Prior art
FIG. 1 is a schematic diagram of the shielding apparatus of the prior art.
Figure 2:
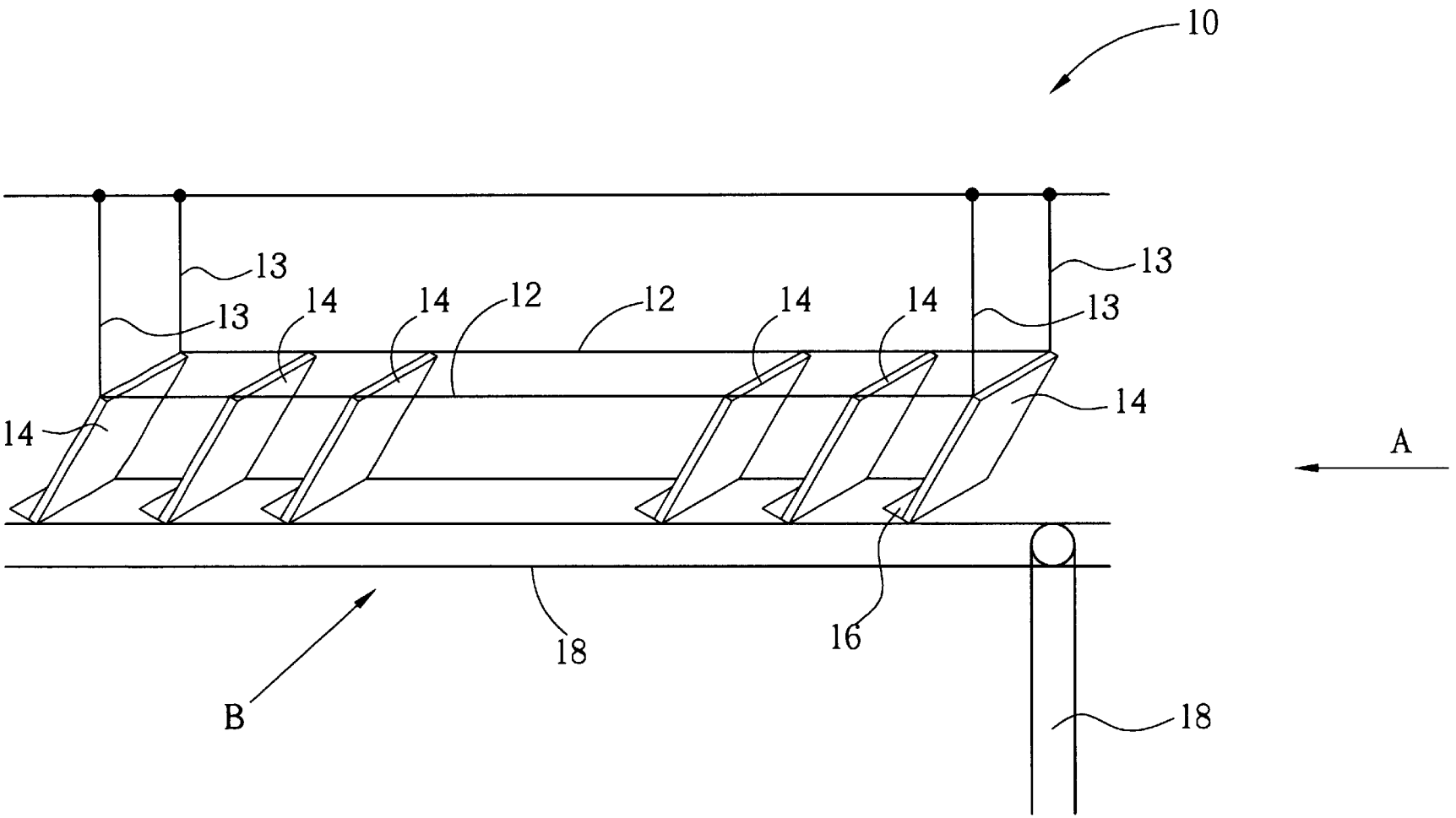
FIG. 2 is an exterior diagram of the preferred embodiment of the present invention.

Please refer to FIG. 2. FIG. 2 is an exterior diagram of the preferred embodiment of the present invention. As shown in FIG. 2, the shielding apparatus 10 comprises four horizontally-directed supporting beams 12 in parallel, four vertically-directed supporting beams 13 in parallel, a plurality of rectangular-shaped flaps 14, and a drain piping 18. The supporting beams 12,13 and the flaps 14 are made of anti-acid zinc plate or anti-acid materials. Each of the supporting beams 12 connects with the corresponding corner of each flap 14. The flaps 14 are of a fixed position, at an incline and in parallel to each other. Each of the supporting beams 13 is connected to a mesh anti-acid zinc-plated steel ledge (not shown) to fix the shielding apparatus 10 over a machine (not shown) below. The drain piping 18 is positioned below the corresponding corner of each flap 14. The area of the shielding apparatus 10 is greater than that of the machine (not shown) below to allow for the protection of the people and the machines from process liquids, tools and debris.

Figure 3:
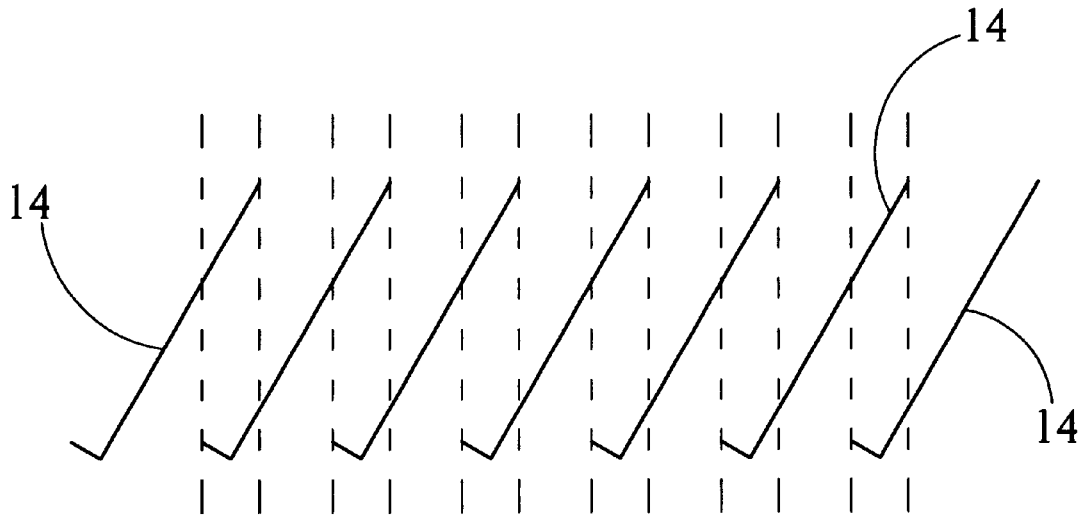
FIG. 3 is a schematic diagram of the relative position of the neighboring flaps as shown in FIG. 2.

Please refer to FIG. 3. FIG. 3 is a schematic diagram of the relative positions of the neighboring flaps 14 as shown in FIG. 2. Each flap 14 is connected to the supporting beam 12 at an angle, and all of the flaps 14 are in parallel to each other. Each flap 14 has areas overlapping with its neighboring flap 14 along a vertical cross-section, with the smallest length of edge area between 1 mm to 20 cm. projected on the vertical cross-section.

Figure 4:
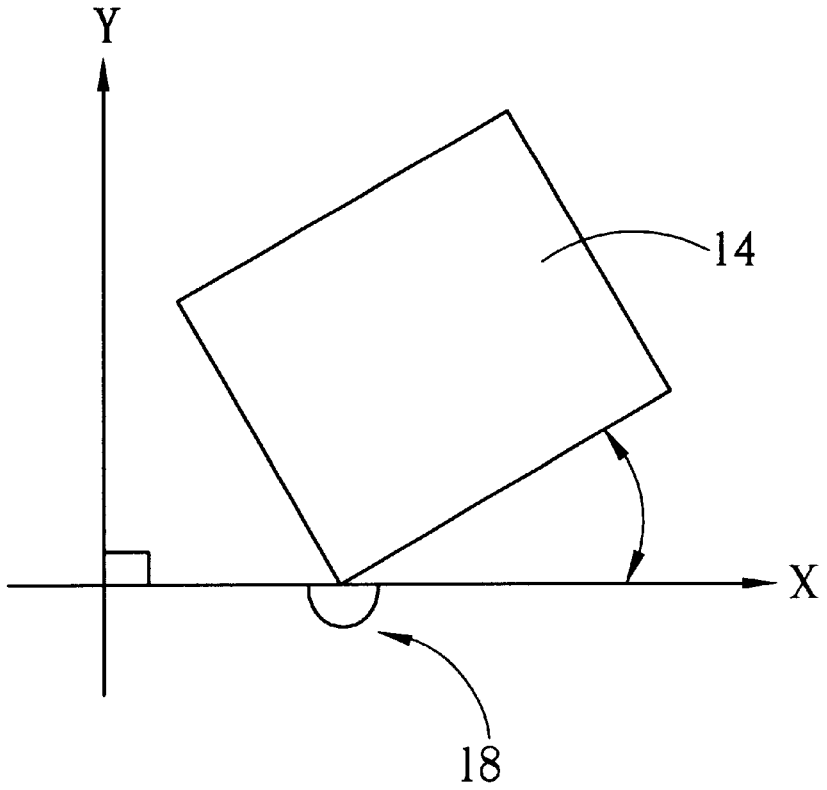
FIG. 4 is a sectional view along line A of a flap 14 as shown in FIG. 2.
Figure 5:
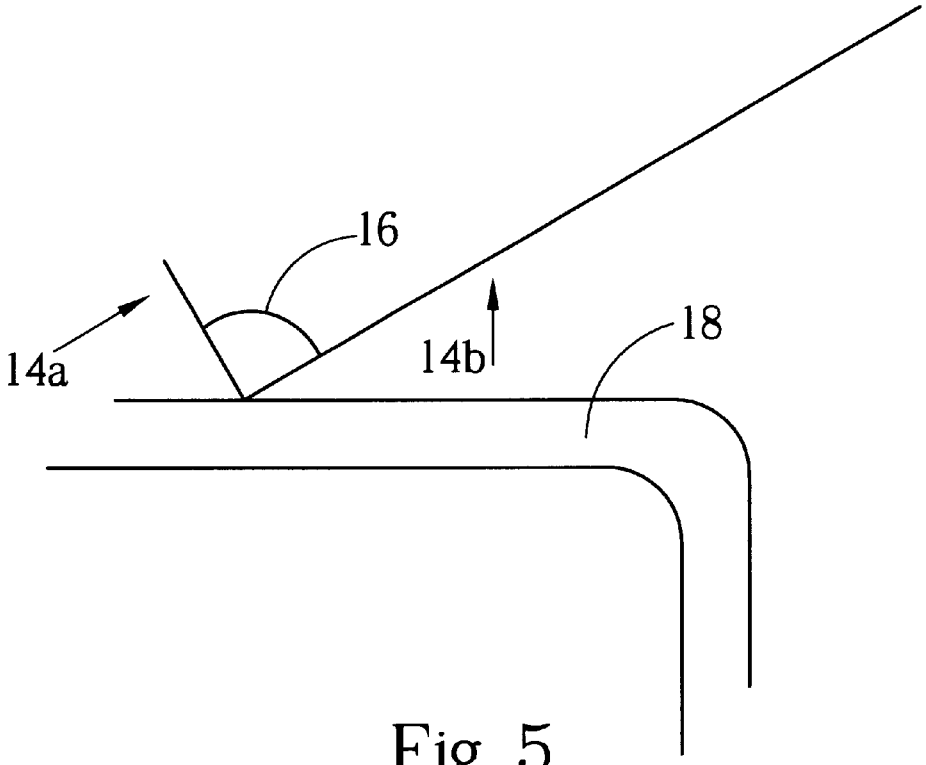
FIG. 5 is a sectional view along line B of a flap 14 as shown in FIG. 2.

Please refer to FIG. 4 and FIG. 5. FIG. 4 and FIG. 5 are sectional views along line A and line B of the flap 14 as shown in FIG. 2, respectively. As shown in FIG. 4, the flap 14 is a rectangular-shaped plate with an incline angle of approximately 1° to 30°. The angle of incline allows for the collection and delivery of the process liquids that may have escaped from the joint of the lines and the tubing, or from the machines on the mesh, and out of the interspace of the mesh and the handrail to harm the machines and people below. As shown in FIG. 5, the bottom of each flap 14 comprises a gutter 16 to collect and deliver the process liquids to the drain piping 18. The drain piping 18 is positioned below the corresponding corner of each flap 14, and delivers the process liquids collected by the gutters 16 to an exit(not shown). Each flap 14 comprises two plates 14*a*, 14*b* (or a L-shape forged plate), connected at an angle to form the gutter 16. Below each of the gutters 16 is the drain piping 18.

Figure 6:
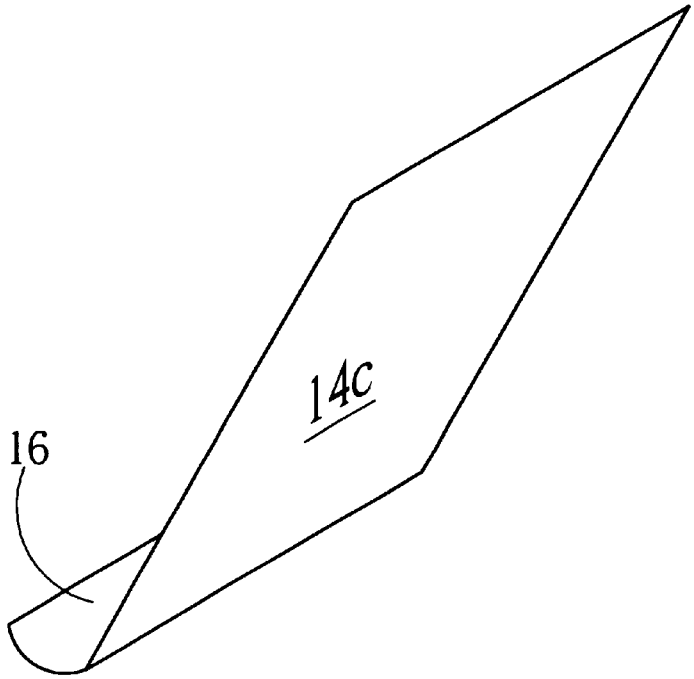
FIG. 6 to FIG. 9 are the second, third, fourth, and the fifth preferred embodiments of the present invention.
Figure 7:
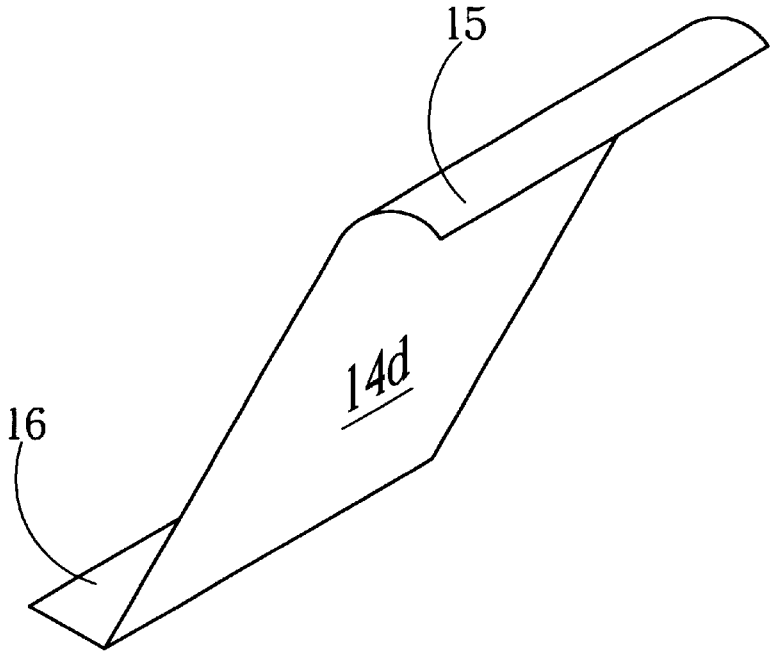

Please refer to FIG. 6. FIG. 6 is the second preferred embodiment of the present invention. Each gutter 16 of a flap 14*c* is arc-shaped, and is not formed by the two plates 14*a*, 14*b*. Please refer to FIG. 7. FIG. 7 is the third preferred embodiment of the present invention wherein each flap 14*d* further comprises a barb-shaped top 15. The process liquids fall onto the barb-shaped top 15 and move down along the segment to the gutter 16 of its flap 14*d* or to the gutter 16 of the neighboring flap 14d. Thus, splashes are prevented from occurring when the process liquids fall onto the top 15 of the flap 14*d*.

Figure 8:
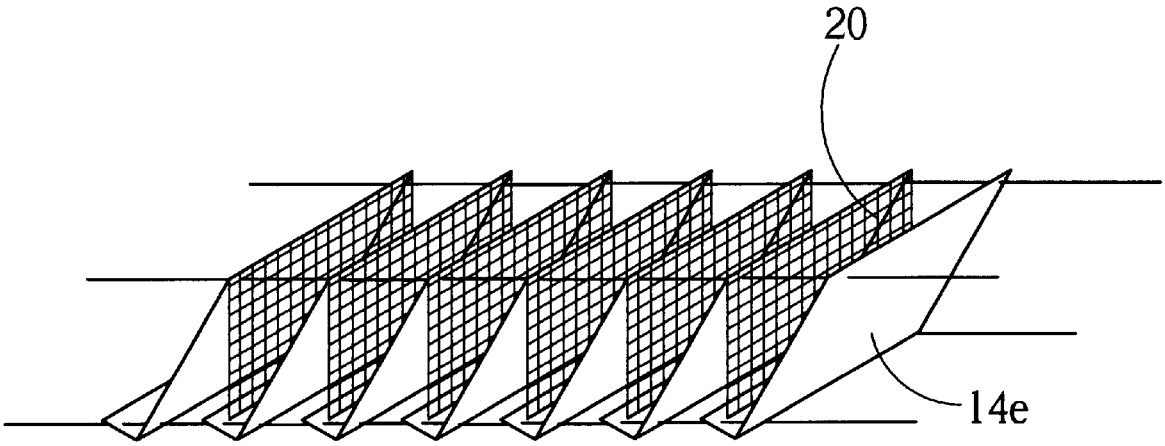
Figure 9:
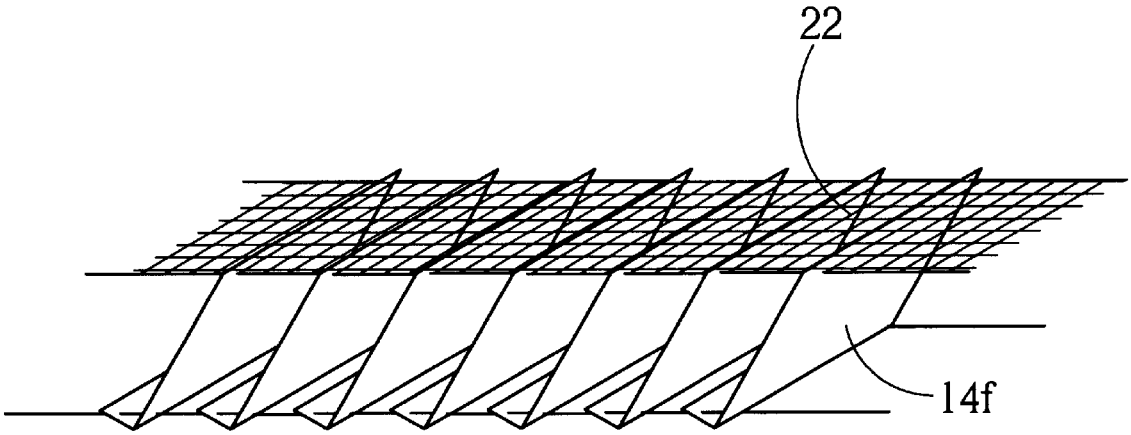

Please refer to FIG. 8 and 9. FIG. 8 and FIG. 9 are the fourth and fifth preferred embodiments of the present invention. As shown in FIG. 8, the top of each flap 14*e* is connected to the bottom of the neighboring flap 14*e* by a mesh plate 20. The layout allows for a better protection of the people and machines from the process liquids, tools and debris. As well, as shown in FIG. 9, the mesh plate 22 can also be installed on the top of each flap 14*f*.

The present invention protects the people and machines below whereby the shielding apparatus is composed of a plurality of inclining flaps 14 in parallel to each other, wherein each flap 14 has areas overlapping with its neighboring flap 14 along a vertical cross-section. Hence, liquids, tools and debris are prevented from passing through the interspace of each flap to harm the people and the machine below. Furthermore, the interspace ensures both proper convection as well as proper maintenance in the level of cleanliness of the clean room.

In contrast to the prior art, the present invention simultaneoulsy protects the people and the machines below and maintains a proper level of cleanliness in the clean room.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A shielding apparatus installed in a clean room, a machine is positioned in the clean room, the shielding apparatus comprising:

at least two supporting beams positioned above the machine in the clean room; and a plurality of flaps connected to the supporting beams, with the top of each flap positioned above the bottom of the neighboring flap.

2. The shielding apparatus of claim 1 wherein each flap is a rectangular-shaped plate, and each of the supporting beams connects to the corresponding corner of each flap.

3. The shielding apparatus of claim 1 wherein each flap is connected to the supporting beam at an angle, and all of the flaps are parallel to each other.

4. The shielding apparatus of claim 1 wherein each flap is an anti-acid zinc-plated steel plate.

5. The shielding apparatus of claim 1 wherein each flap has an area overlapping with the neighboring flap along a vertical cross-section, the smallest length of edge area being between 1 mm to 20 cm. projected on the vertical cross-section.

6. The shielding apparatus of claim 1 wherein the top of each flap is connected to the bottom of the neighboring flap by a mesh plate.

7. The shielding apparatus of claim 1 wherein each flap comprises a gutter at the bottom, and two plates connected at an angle to form the gutter.

8. The shielding apparatus of claim 1 wherein the bottom of the flap is an arc-shaped gutter, the gutter used to collect and deliver liquids.

9. The shielding apparatus of claim 1 wherein each flap further comprises a barb-shaped top.

10. A shielding apparatus installed in a clean room, used to protect a machine, the shielding apparatus comprising:

at least two supporting beams positioned above the machine in the clean room;

a plurality of flaps connected to the supporting beams, each flap comprising a gutter on its bottom, and a top positioned above the gutter of the neighboring flap; and a drain piping positioned below the corresponding corner of each flap, to deliver liquids collected by the gutters to an exit.

11. The shielding apparatus of claim 10 wherein each flap is a rectangular-shaped plate, with each of the supporting beams connecting to the corresponding corner of each flap.

12. The shielding apparatus of claim 10 wherein each flap is connected to the supporting beam at an angle, and all of the flaps are parallel to each other.

13. The shielding apparatus of claim 10 wherein the corner of the flap adjacent to the drain piping is lower than the other corner at the bottom of the flap to allow the liquids in the gutter to flow into the drain piping.

14. The shielding apparatus of claim 13 wherein the incline angle of the shielding apparatus is approximately 1° to 30°.

15. The shielding apparatus of claim 10 wherein each flap is an anti-acid zinc-plated steel plate.

16. The shielding apparatus of claim 10 wherein each flap has an area overlapping with the neighboring flap along a vertical cross-section, the smallest length of edge area being 1 mm to 20 cm. projected on the vertical cross-section.

17. The shielding apparatus of claim 10 wherein the top of each flap is connected to the bottom of the neighboring flap by a mesh plate.

18. The shielding apparatus of claim 10 wherein the gutter is formed by two plates connected at an angle.

19. The shielding apparatus of claim 10 wherein the bottom of the flap is an arc-shaped gutter, the gutter used to collect and deliver a liquid.

20. The shielding apparatus of claim 10 wherein each flap further comprises a barb-shaped top.

* * * * *